US011773574B2

(12) United States Patent
Ali

(10) Patent No.: US 11,773,574 B2
(45) Date of Patent: Oct. 3, 2023

(54) DRAIN STRAINER

(71) Applicant: Naushad Ali, Woodinville, WA (US)

(72) Inventor: Naushad Ali, Woodinville, WA (US)

(73) Assignee: Drain Strain, LLC, Woodinville, WA (US)

( * ) Notice: Subject to any disclaimer, the term of this patent is extended or adjusted under 35 U.S.C. 154(b) by 0 days.

(21) Appl. No.: 17/292,408

(22) PCT Filed: Nov. 6, 2019

(86) PCT No.: PCT/US2019/060073
§ 371 (c)(1),
(2) Date: May 7, 2021

(87) PCT Pub. No.: WO2020/097207
PCT Pub. Date: May 14, 2020

(65) Prior Publication Data

US 2022/0010536 A1 Jan. 13, 2022

Related U.S. Application Data

(60) Provisional application No. 62/757,624, filed on Nov. 8, 2018.

(51) Int. Cl.
*E03C 1/262* (2006.01)
*E03C 1/23* (2006.01)

(52) U.S. Cl.
CPC ..... *E03C 1/262* (2013.01); *E03C 1/2306* (2013.01)

(58) Field of Classification Search
CPC . E03C 1/26; E03C 1/264; E03C 1/262; E03C 1/2306; A47K 1/14
See application file for complete search history.

(56) References Cited

U.S. PATENT DOCUMENTS

| | | | |
|---|---|---|---|
| 769,001 | A | 8/1904 | Lawrence |
| 1,756,290 | A | 4/1930 | Hibner |
| 1,770,639 | A | 7/1930 | West et al. |
| 2,285,833 | A | 6/1942 | Platt |
| 2,331,055 | A | 10/1943 | Smith |
| 2,337,331 | A | 12/1943 | Kirschner |

(Continued)

FOREIGN PATENT DOCUMENTS

| | | | |
|---|---|---|---|
| CN | 201762779 | U | 3/2011 |
| JP | 2008-25276 | A | 2/2008 |

(Continued)

OTHER PUBLICATIONS

International Search Report and Written Opinion, dated May 15, 2013, for International Application No. PCT/US2013/022289, 10 pages.

(Continued)

*Primary Examiner* — Janie M Loeppke
(74) *Attorney, Agent, or Firm* — Seed IP Law Group LLP

(57) ABSTRACT

A stopper cartridge for a drain system of a fluid basin, components thereof and related methods are provided. The stopper cartridge includes a stopper head and a strainer to strain fluid passing through the drain system when the stopper head is in a drain position. The stopper head and the strainer may be selectively removable from the drain system by manipulating the stopper head relative to the drain system or a component installed in the drain system.

20 Claims, 15 Drawing Sheets

(56) References Cited

U.S. PATENT DOCUMENTS

| | | | | |
|---|---|---|---|---|
| 2,481,312 | A * | 9/1949 | Kirschner | E03C 1/262 4/287 |
| 2,698,441 | A | 1/1955 | Shobe | |
| 3,333,815 | A | 8/1967 | Downey et al. | |
| 3,588,928 | A | 6/1971 | Hiertz | |
| 3,596,294 | A | 8/1971 | Hoffman | |
| 3,800,339 | A | 4/1974 | Bergin | |
| 3,802,001 | A | 4/1974 | Richards | |
| 3,813,708 | A | 6/1974 | Hamburg | |
| 3,911,508 | A | 10/1975 | Goldberg | |
| 4,045,351 | A | 8/1977 | Peterson | |
| 4,207,631 | A | 6/1980 | Baggey | |
| 4,276,662 | A | 7/1981 | Young | |
| 4,369,531 | A | 1/1983 | Swanson | |
| 4,380,834 | A | 4/1983 | Wentz | |
| 4,571,751 | A | 2/1986 | Barlow | |
| 4,597,112 | A | 7/1986 | Cuschera | |
| 4,720,877 | A | 1/1988 | Watts | |
| 4,860,390 | A | 8/1989 | Ohta | |
| 4,932,082 | A | 6/1990 | Ridgeway | |
| 5,072,461 | A | 12/1991 | Logsdon | |
| 5,165,118 | A | 11/1992 | Cendrowski | |
| 5,369,815 | A | 12/1994 | Martin | |
| D357,306 | S | 4/1995 | Lenox | |
| 5,592,701 | A | 1/1997 | Smith | |
| 5,724,684 | A | 3/1998 | Paar | |
| 5,915,847 | A | 6/1999 | Spears | |
| 6,058,526 | A | 5/2000 | Parisi et al. | |
| 6,067,669 | A | 5/2000 | Peterson et al. | |
| 6,108,828 | A | 8/2000 | Cheng | |
| 6,145,136 | A | 11/2000 | Parisi et al. | |
| 6,263,518 | B1 | 7/2001 | Magtanong | |
| D450,106 | S | 11/2001 | Herr | |
| D454,941 | S | 3/2002 | Dietzel | |
| 6,418,568 | B1 | 7/2002 | Briggs et al. | |
| 6,845,528 | B2 | 1/2005 | Bantz | |
| 7,013,500 | B1 | 3/2006 | Lin | |
| 7,442,296 | B2 | 10/2008 | Chong et al. | |
| 7,625,488 | B2 | 12/2009 | Blackburn | |
| 7,704,386 | B2 | 4/2010 | Ventura | |
| D644,072 | S | 8/2011 | McDonald et al. | |
| 8,011,030 | B2 | 9/2011 | Li | |
| 8,214,942 | B2 | 7/2012 | Yang et al. | |
| D691,418 | S | 10/2013 | Minton et al. | |
| 8,590,065 | B2 | 11/2013 | Ali et al. | |
| 8,813,272 | B2 | 8/2014 | Ball | |
| 9,371,636 | B2 | 6/2016 | Ali et al. | |
| 9,499,962 | B2 | 11/2016 | Joseph | |
| 9,518,383 | B2 | 12/2016 | Lesmeister | |
| D792,562 | S | 7/2017 | Ali | |
| D814,611 | S | 4/2018 | Karnegie | |
| 9,945,106 | B2 | 4/2018 | Ali et al. | |
| 10,106,967 | B2 | 10/2018 | Sebolt | |
| 10,501,917 | B2 | 12/2019 | Ali et al. | |
| 11,391,027 | B1 * | 7/2022 | Ali | A47K 1/14 |
| 2004/0255378 | A1 | 12/2004 | Tracy | |
| 2006/0248637 | A1 | 11/2006 | Pan | |
| 2008/0244825 | A1 | 10/2008 | Delmonico | |
| 2008/0282466 | A1 | 11/2008 | Swan | |
| 2009/0172870 | A1 | 7/2009 | Hong | |
| 2010/0000011 | A1 | 1/2010 | Angarita | |
| 2010/0071122 | A1 * | 3/2010 | Li | E03C 1/262 4/287 |
| 2010/0138985 | A1 | 6/2010 | Duncan | |
| 2010/0205734 | A1 | 8/2010 | Peterson | |
| 2011/0000014 | A1 | 1/2011 | Ball et al. | |
| 2011/0126347 | A1 | 6/2011 | Qian et al. | |
| 2011/0185494 | A1 | 8/2011 | Beck et al. | |
| 2013/0185855 | A1 | 7/2013 | Ali et al. | |
| 2014/0007334 | A1 | 1/2014 | Golibart | |
| 2014/0115777 | A1 | 5/2014 | Schulze | |
| 2014/0173819 | A1 | 6/2014 | Ali et al. | |
| 2016/0251839 | A1 * | 9/2016 | Ali | E03C 1/2302 4/287 |
| 2017/0030060 | A1 | 2/2017 | Ali et al. | |

FOREIGN PATENT DOCUMENTS

| | | | |
|---|---|---|---|
| KR | 20-0403195 | Y1 | 12/2005 |
| KR | 10-2010-0065614 | A | 6/2010 |
| WO | 2013/112385 | A1 | 8/2013 |

OTHER PUBLICATIONS

International Search Report and Written Opinion, dated Feb. 27, 2020, for International Application No. PCT/US2019/060073, 14 pages.

* cited by examiner

DRAIN STRAINER

BACKGROUND

Technical Field

The present disclosure relates to a stopper assembly for a drain system of a fluid basin, and in particular, a stopper assembly with a replaceable strainer element.

Description of the Related Art

Conventional bathroom sinks typically include a stopper that serves to selectively seal or open a drain in a sink basin. The stopper is mounted to the top of a plunger seated in a drain pipe that extends below the sink basin. The stopper can be moved between open and closed positions by actuating a lever located near the sink faucet. The lever is typically mechanically linked to a horizontal rod that extends below the sink and transmits motion imparted on the lever to the plunger. The horizontal rod typically extends through a pivot seat in the drain pipe to achieve the desired lifting and lowering motion of the plunger. By actuating the lever, a user is able to raise and lower the stopper, and thereby select whether to open or close the sink drain.

The conventional drain and stopper mechanisms described above, however, can be problematic. For example, the horizontal rod tends to become misaligned relative to the plunger or the lever after a relatively short period of use, resulting in the stopper sagging or tilting in the open position or failing to close properly. In addition, hair and foreign objects that pass through the drain can clog up the sink, making it necessary to either disassemble the pipes located beneath the sink in order to unclog the drain, or to call a plumber. There is also a risk that valuable items, such as rings and contact lenses, can fall into the sink drain and potentially be lost. It is known to include a strainer beneath a stopper in a bathroom sink, tub or other fluid basin. However, conventional strainer assemblies for bathroom sinks, tubs or other fluid basins can be difficult to access for cleaning and replacement.

BRIEF SUMMARY

Embodiments described herein provide systems and methods that enable a strainer element to be installed in a drain of a fluid basin and selectively replaced as desired in a particularly efficient and sanitary manner. Systems include, for example, a removable strainer cartridge having a replaceable strainer element. In some instances, the replaceable strainer element can be released from the strainer cartridge without contacting the strainer element, which may be full of collected debris. In some, embodiments the strainer cartridge may be installed in a simple drop-in or clip-in manner, and provide straining functionality in addition to drain stopper functionality.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known features or structures associated with fluid basins, drain systems, drain stoppers and strainers may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

FIGS. 1 through 9 show a stopper cartridge 10 for a drain system of a fluid basin according to one example embodiment. The stopper cartridge 10 is configured to be installed in a fluid basin (e.g., a sink basin) with the stopper cartridge 10 movable between an unplugged or drain position and a plug position. In the unplugged or drain position, fluid (e.g., water) may drain out of the fluid basin via the drain system. The drain system may include a drain pipe that extends below the fluid basin and that includes an upper portion having a sink flange that is received within a drain opening of the basin. The upper end of the drain system may be shaped to closely receive an upper end 30 of the stopper cartridge 10 when the stopper cartridge 10 is moved downward from the drain position to the plug position. The upper end 30 of the stopper cartridge 10 may include a seal device 32, such as, for example, a gasket or an o-ring to sealingly engage the drain system when the stopper cartridge 10 is moved into the plug position to prevent fluid (e.g., water) from draining out of the basin. In other instances, a seal device 32, such as a bead or lip, may be formed integrally with the upper end 30 of the stopper cartridge 10. The stopper cartridge 10 may be conveniently moved between the drain position and the plug position by a user manipulating the stopper cartridge 10 within the drain system.

Figure 1:
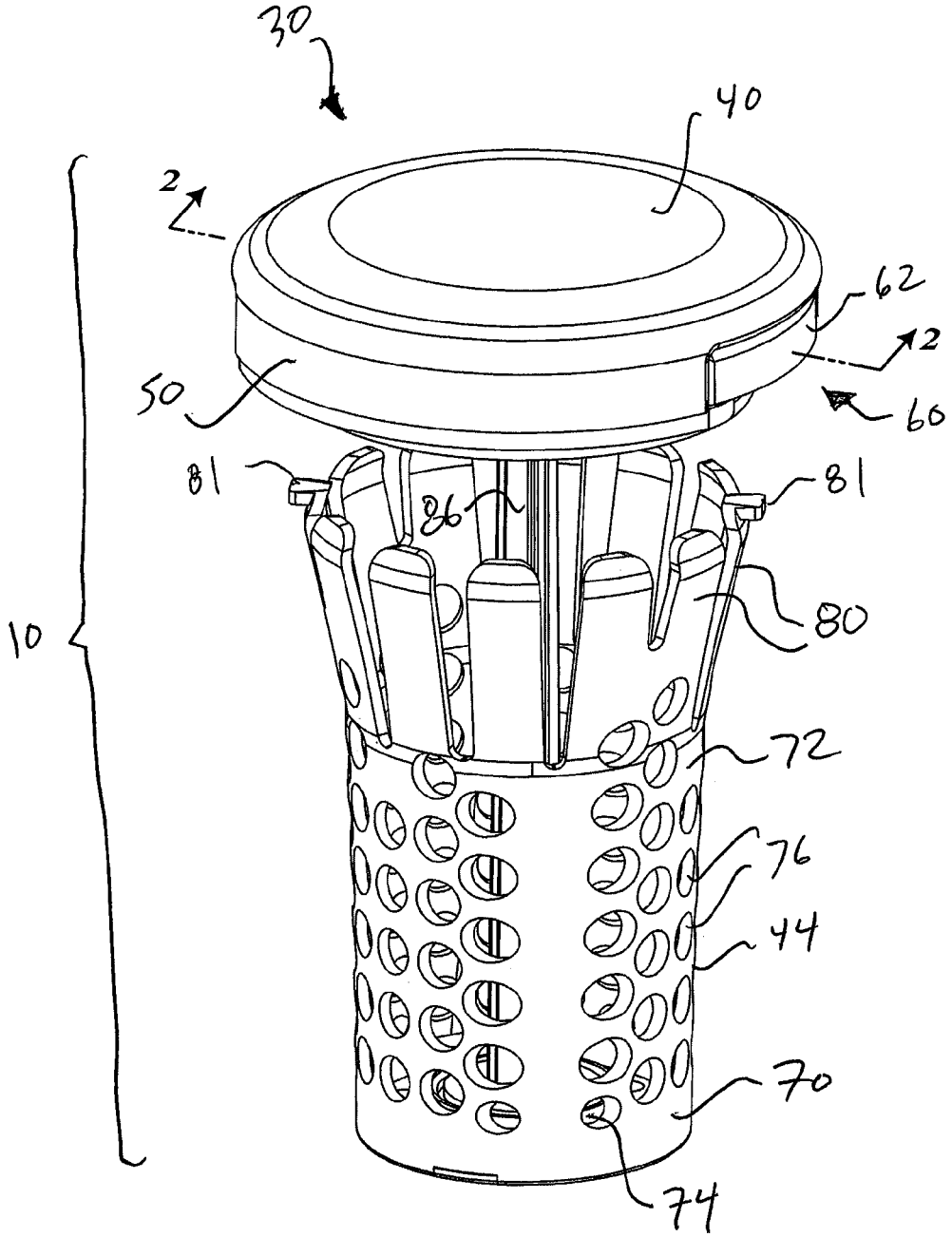
FIG. 1 is an isometric view of a strainer cartridge, according to an example embodiment.
Figure 2:
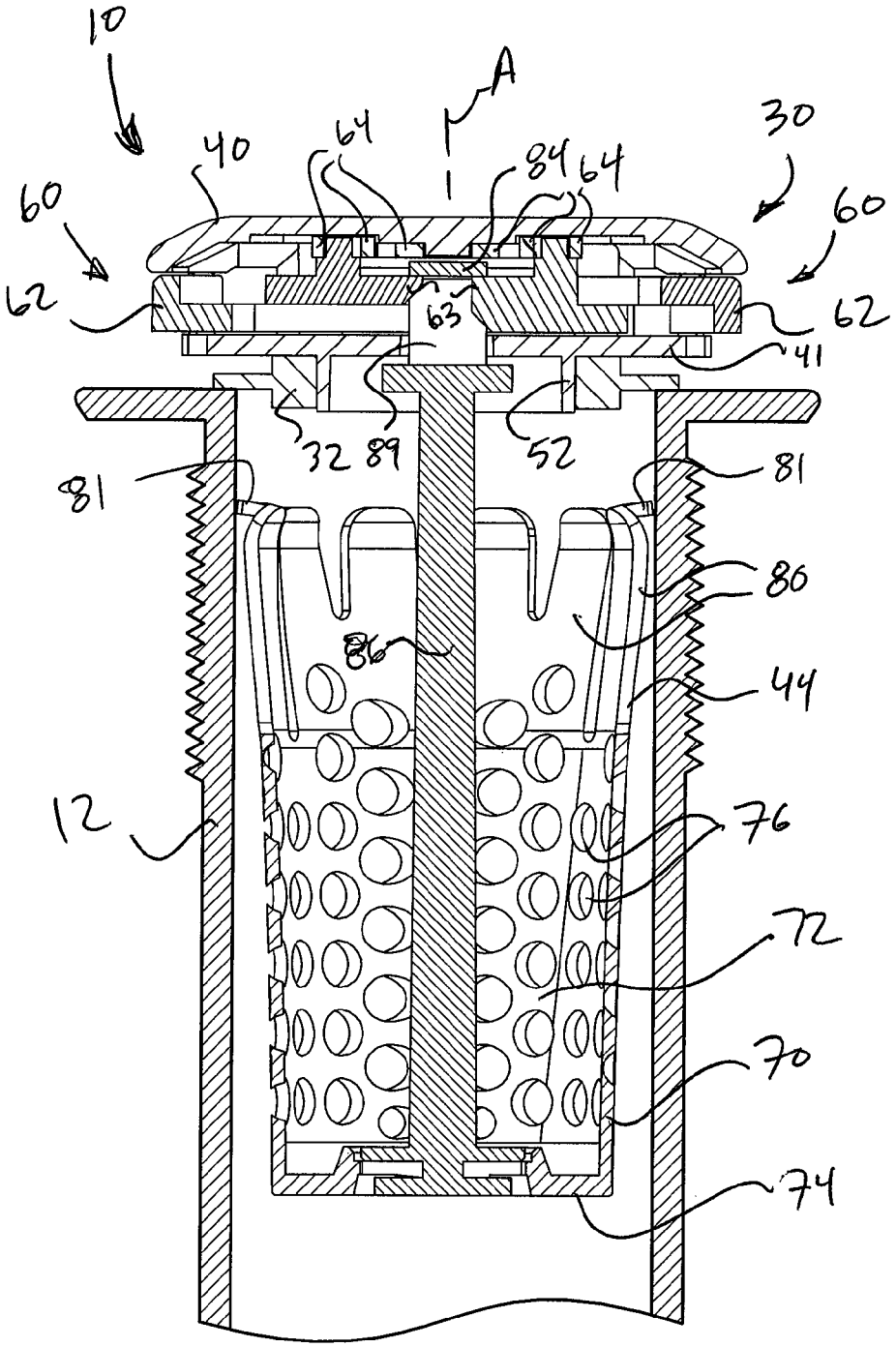
FIG. 2 is a cross-sectional side view of the strainer cartridge of FIG. 1 shown installed in a drain body and in a plugged configuration.
Figure 3:
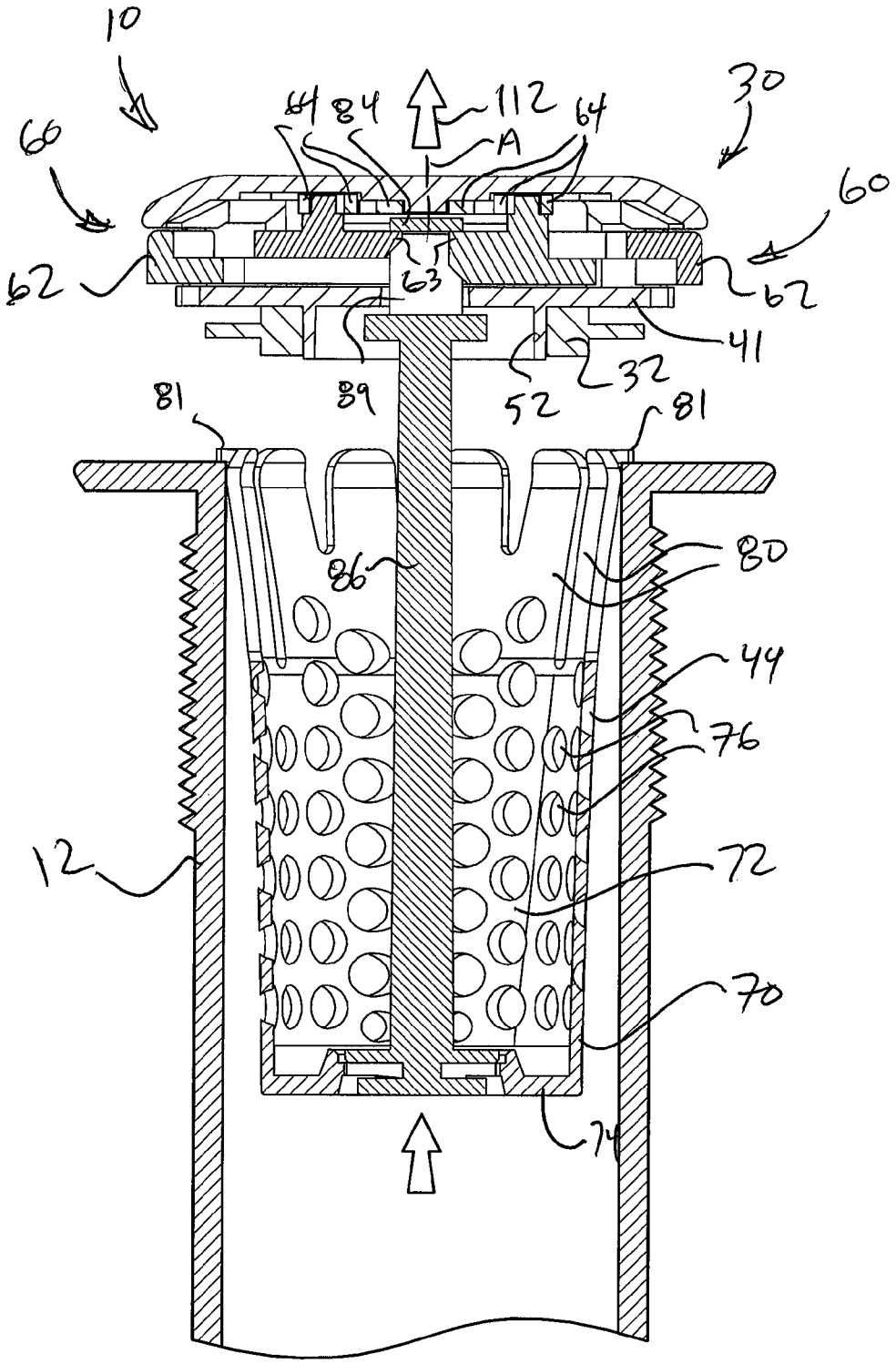
FIG. 3 is a cross-sectional side view of the strainer cartridge of FIG. 1 shown installed in the drain body and in an unplugged or drain configuration.
Figure 4:
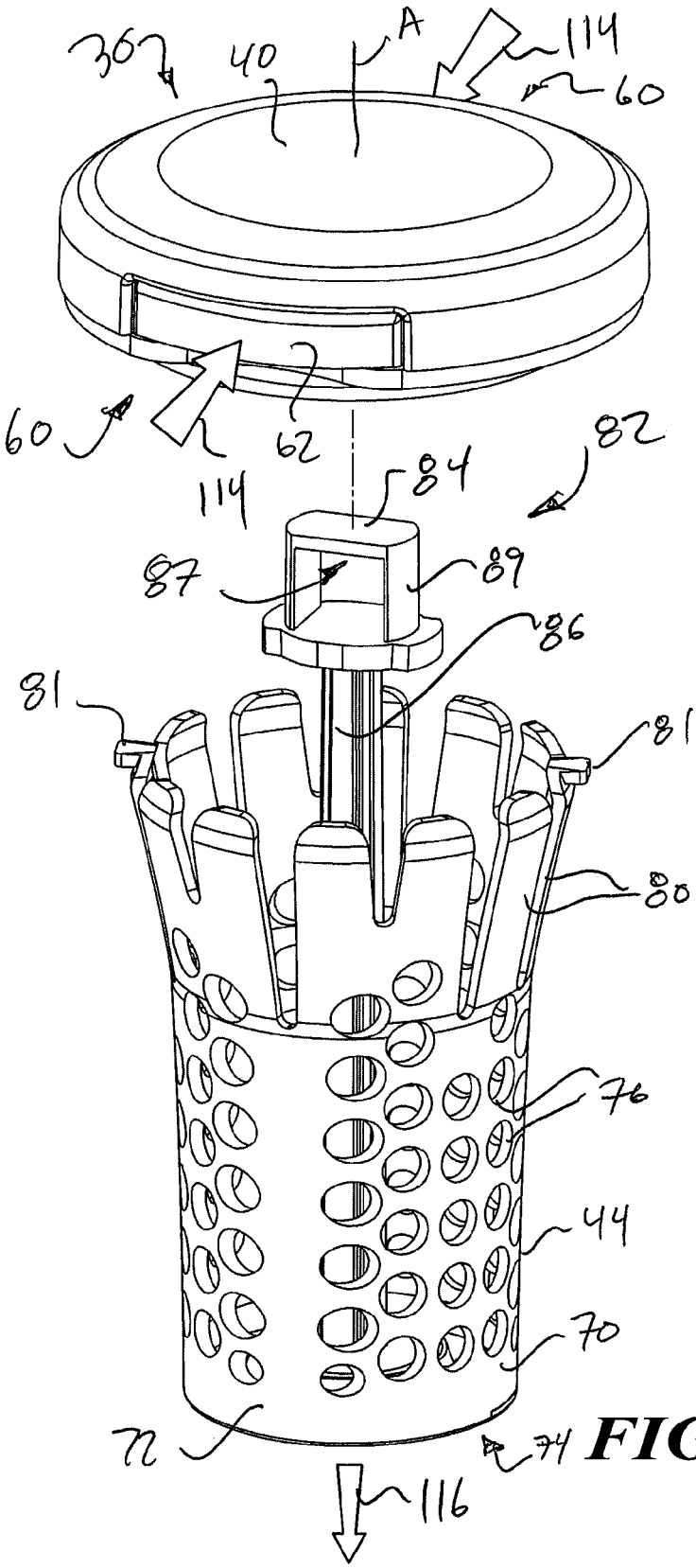
FIG. 4 is an isometric view of the strainer cartridge of FIG. 1 with a strainer thereof detached from a stopper head thereof.

With reference to FIGS. 1 through 3, the stopper cartridge 10 comprises a stopper head 40 and a strainer 44. The stopper head 40 is provided at the upper end 30 of the stopper cartridge 10 and is selectively attachable to the strainer 44. The strainer 44 is coupled beneath the stopper head 40 to trap debris or other matter as fluid passes through the strainer 44 during use. In some embodiments, the strainer 44 may be detachably coupled to the stopper head 40, as discussed in further detail below. In other embodiments, the strainer 44 may be fixedly attached or permanently attached to the stopper head 40 or integrally formed therewith. Advantageously, when the strainer 44 is detachably coupled to the stopper head 40, the strainer 44 may be removed with the stopper head 40 and selectively replaced with a replacement strainer 44 in a particularly convenient manner. In other instances, the strainer 44 may be removed with the stopper head 40 and cleaned for reuse in the drain system.

The stopper head 40 may have a generally circular profile similar to conventional stoppers, or may have other shapes. As shown in FIGS. 1 through 8, the stopper head 40 may have a general mushroom shape with an enlarged head portion 50 and a reduced neck portion 52. The seal device 32 described above may be positioned around the reduced neck portion 52. The stopper head 40 may further include features for selectively engaging the strainer 44, as discussed in greater detail elsewhere.

Advantageously, the stopper head 40 and the strainer 44 attached thereto can be removed from the drain system by simply pulling the strainer cartridge 10 out of the drain system.

As previously indicated, the stopper head 40 may include coupling devices for selectively engaging the strainer 44. For instance, the example embodiment includes a release mechanism 60 that may be actuated to release a pair of spring-biased latch members 62 from engagement with a stopper head engagement feature 84 of the strainer 44. The strainer 44 may be released, separated or detached from the stopper head 40 by actuating the release mechanism 60 toward the central axis A.

Figure 5:
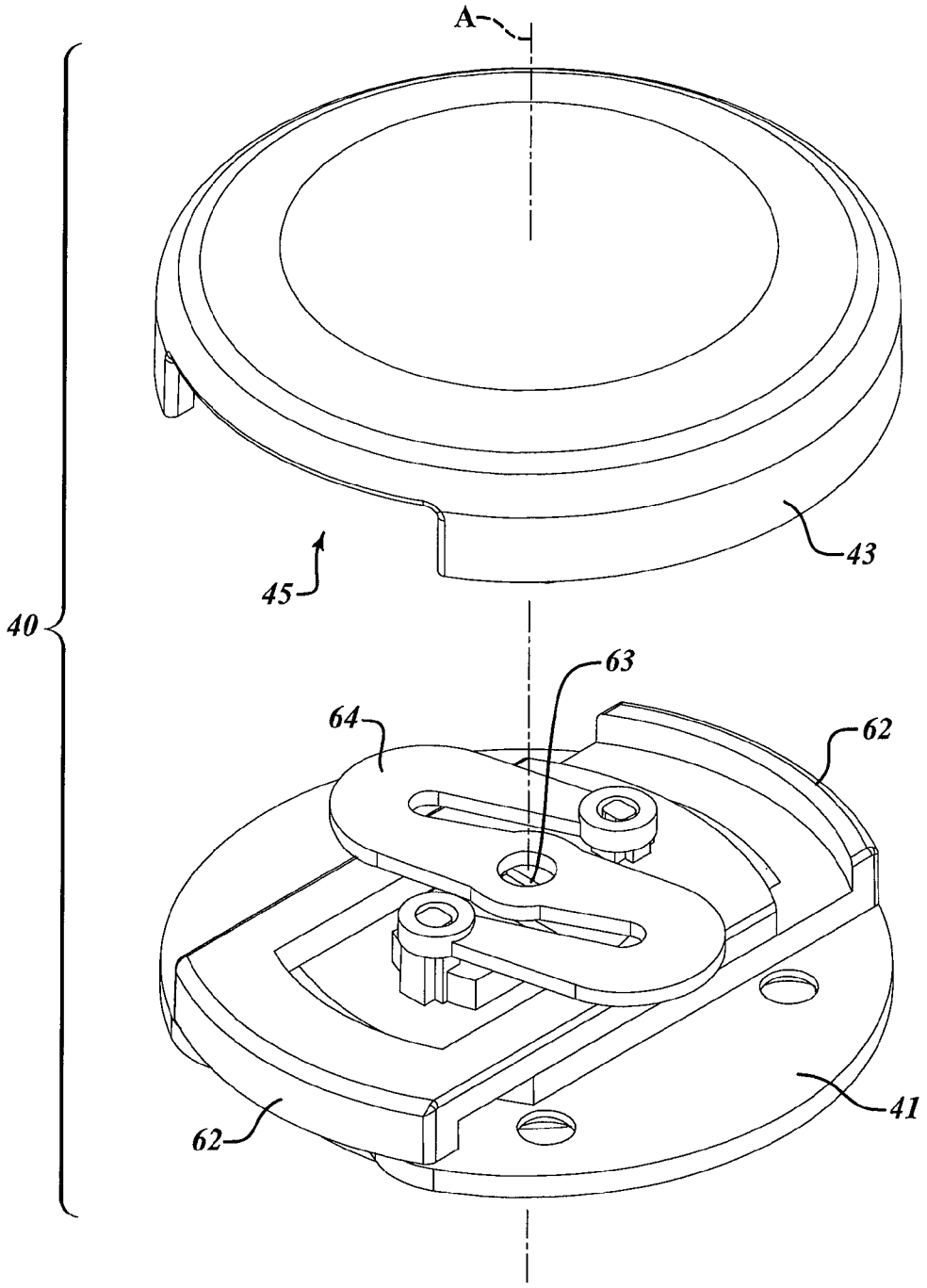
FIG. 5 is a partially exploded view of the stopper head of the strainer cartridge of FIG. 1 revealing internal components thereof.
Figure 6:
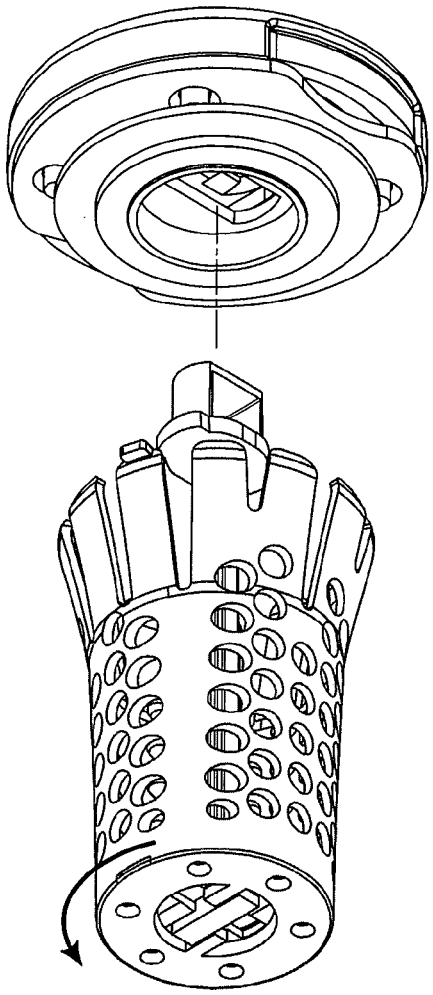
FIG. 6 is an isometric view of the strainer cartridge of FIG. 1 shown with the stopper head thereof separated from the strainer thereof.
Figure 7:
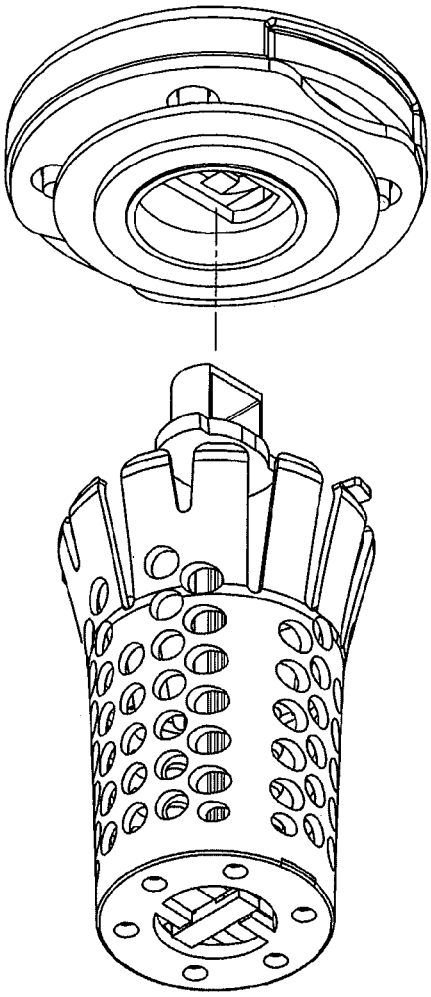
FIG. 7 is an isometric view of the strainer cartridge of FIG. 1 shown with the stopper head thereof separated from the strainer thereof, and with the strainer body rotated relative to a strainer stem to detach the strainer stem from the strainer body.
Figure 8:
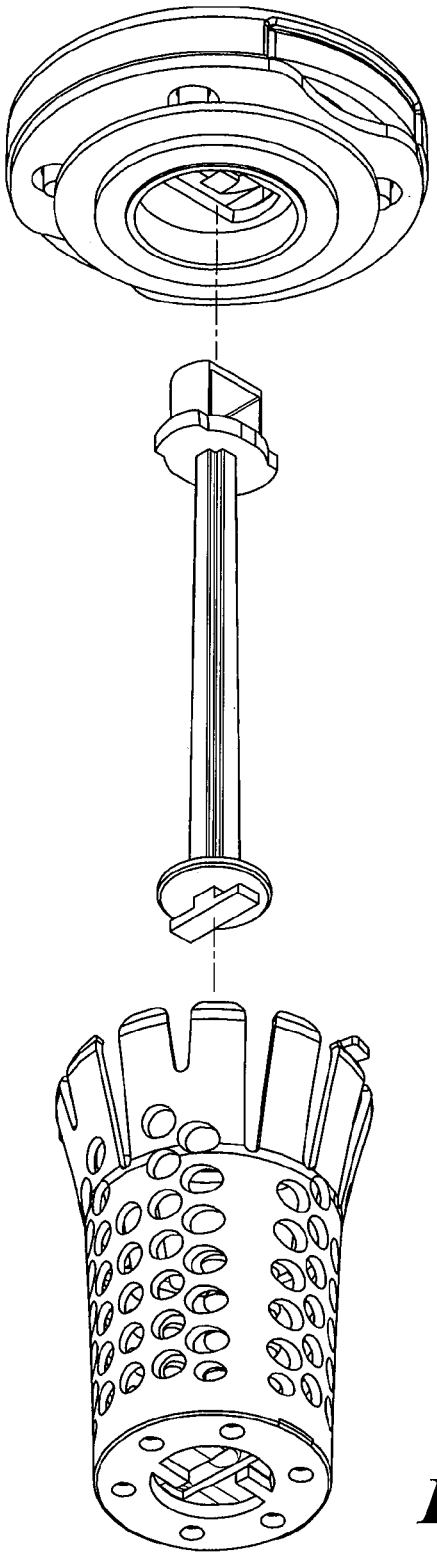
FIG. 8 is an isometric exploded view of the strainer cartridge of FIG. 1.

In some embodiments, the release mechanism 60 may be substantially contained within the stopper head 40, as shown best in the partially exploded view of the stopper head 40 of FIG. 5 and the cross-sectional views of FIGS. 2 and 3, with ends of the spring-biased latch members 62 being accessible to a user at the periphery of the stopper head 40. The spring-biased latch members 62 may be configured relative to a spring element 64 such that latching ends 63 of the latch members 62 are biased inwardly toward the central axis A. A user may actuate the latch members 62 by pressing exposed portions of the latch members 62 inwardly against the bias of the spring element 64 to release the stopper head engagement feature 84 of the strainer 44 from the latch members 62 as the latching ends 63 of the latch members 62 move away from the central axis A. The stopper head engagement feature 84 may comprise a bridge structure or platform supported by opposing ears or supports 89. The latching ends 63 may include sloped or ramped surfaces such that the stopper head engagement feature 84 may be pressed into a cavity of the stopper head 40 and cause the latching ends of the latch members 62 to move outwardly and then back inwardly to retain the stopper head engagement feature 84 without use of the user-manipulable portions of the latch members 62. Advantageously, a user can quickly snap the stopper head 40 onto a replacement strainer 44 as needed. The release mechanism 60 may be substantially contained within the stopper head 40 between a cap portion 43 and a bottom housing member 41, a portion of which may define the reduced neck portion 52 and provide a mounting arrangement for the seal device 32. The cap portion 43 may include recesses 45 for providing access to the user-manipulable portions of the release mechanism 60. Although the user-manipulable portions of the release mechanism 60 are shown as extending through the periphery of the cap portion 43, in some embodiments, the user-manipulable portions of the release mechanism 60 may be concealed beneath a cap or cover that reflects those of conventional drain stoppers.

In other embodiments, the stopper head 40 and the strainer 44 may include other features for facilitating selective engagement and disengagement of the same, such as, for example, a detent mechanism, clips, snaps or other fasteners. Irrespective of the particular release mechanism 60, in some embodiments, the stopper head 40 and the strainer 44 are configured to enable separation of the stopper head 40 from the strainer 44 after the stopper head 40 and strainer 44 are removed as a strainer cartridge 10 from the drain system. For example, in accordance with the example embodiment shown in FIGS. 1 through 9, the strainer 44 is selectively detachable from the stopper head 40 without requiring a user to touch or otherwise contact the strainer 44. This may be particularly advantageous when replacing a strainer 44 that is soiled with debris, such as, for example, hair and other matter that collects in the strainer 44 during use.

In some embodiments, the strainer 44 may include a body portion defining a receptacle 70. The receptacle 70 may include a sidewall 72 extending from a periphery of a base 74. Each of the sidewall 72 and the base 74 may include a plurality of apertures 76 to form a strainer structure to strain fluid passing through the receptacle 70 during operation of the drain system. The receptacle 70 may be generally cylindrical. In some embodiments, the strainer 44 may taper in a downstream direction such that, when the strainer 44 is in position for use within the drain system and a lower portion of the strainer 44 is blocked with collected debris, fluid can bypass the debris in the strainer 44 via the apertures in the sidewall 72 and a gap between the strainer 44 and the drain pipe of the drain system.

An upstream end of the strainer 44 may include a plurality of flexible fingers 80 that splay outward from the central axis A of the strainer 44. The fingers 80 may flex in response to contact with the drain pipe as the stopper cartridge 10 is moved into the plug position. In the drain position, the fingers 80 may extend near or in close proximity to the drain pipe or may contact the drain pipe. In this manner, most of the fluid and any matter passing into the drain system inevitably passes through the receptacle 70 of the strainer 44. At least one of the flexible fingers 80 may include a laterally extending projection 81 configured to support the strainer cartridge 10 in the drain position within the drain system (as shown in FIG. 3) and configured to flex inwardly when a user moves the stopper assembly from the drain position to the plug position, as shown in FIG. 2. The laterally extending projection(s) 81 may be configured to support the strainer cartridge 10 in the drain position by resting on a lip or ledge of a drain body 12 of the drain system.

The strainer 44 may include an upper portion 82 having a stopper head engagement feature 84 to detachably couple the strainer 44 to the stopper head 40 to form the strainer cartridge 10. The stopper head engagement feature 84 may include, for example, a structure engageable by the spring-biased latch members 62 of the stopper head 40. In other embodiments, the engagement feature may include a detent mechanism, clips, snaps or other fastener devices. The upper portion 82 may be part of a central stem or elongated member 86 that extends in the direction of the central axis A from a bottom end of the strainer to an upper end of the strainer 44. The stem or elongated member 86 may be detachably coupled to the body portion that defines the receptacle 70.

A method of using the stopper cartridge 10 to remove debris from a drain system of a fluid basin will now be described. The method may begin with installing the stopper cartridge 10 in the drain system such that it may be selectively moved between an unplugged or drain position and a plug position.

Fluid and debris may then be intermittently passed through the drain system as the fluid basin is used on a daily or periodic basis. As the fluid and debris flows through the drain system, a substantial portion passes through the strainer 44 of the stopper cartridge 10 and at least some or a significant portion of the debris will become trapped in the strainer 44. Debris may therefore accumulate in the strainer 44 over time. The strainer 44 may then be removed and cleaned or replaced as desired to clear the drain system of the collected debris.

In particular, the strainer cartridge 10, which comprises the stopper head 40 and the strainer 44 holding the debris, may be removed from the drain system of the fluid basin by simply pulling the strainer cartridge 10 out of the drain system. In this manner, the strainer cartridge 10 can be quickly removed from the drain system with minimal effort and without disassembling the drain system.

After removing the strainer cartridge 10 from the drain system, the strainer 44 and the debris collected therein can be released from the stopper head 40 by actuating a release mechanism 60 on the stopper head 40 of the strainer cartridge 10. Actuating the release mechanism may include, for example, actuating a pair of opposing spring-biased latch members 62 to release the strainer 44, as indicated by the arrows labeled 114. Once released, the strainer 44 may fall under the influence of gravity into a waste or compost receptacle, as represented by the arrow labeled 116. Next, a replacement strainer 44 may be attached to the stopper head 40 to form a replacement strainer cartridge 10, and the replacement strainer cartridge 10 may be installed back in the drain system. Alternatively, the debris collected in the strainer 44 may be emptied into a waste or compost receptacle and the strainer 44 reattached to the stopper head 40 for reuse.

Other methods of removing debris or otherwise reducing clogging of a drain system of a fluid basin may be provided in view of the stopper cartridges 10, components and systems described herein. For example, a method of reducing clogging may include installing a strainer cartridge 10, comprising a stopper head 40 and a strainer 44 coupled to the stopper head 40, into the drain system of the fluid basin; operating the drain system with the strainer cartridge 10 in position; removing the strainer cartridge 10 from the drain system after the strainer 44 has captured debris; operating a release mechanism 60 of the strainer cartridge 10 to release the strainer 44 and debris from the stopper head 40; attaching a replacement strainer 44 to the stopper head 40 to form a replacement strainer cartridge 10; and installing the replacement strainer cartridge 10 into the drain system of the fluid basin.

In addition, it is appreciated that some methods may include detaching the stopper head 40 from the strainer 44 while the strainer 44 is still within the drain, such as by actuating the release mechanism 60 while the strainer 44 remains within the drain. The user may then grab and manipulate the upper portion 82 of the strainer 44 to remove the strainer 44 from within the drain. The user may then dispose of the strainer 44 or clean the strainer 44 to be used in the drain again. The strainer 44 or a replacement strainer 44 may then be positioned back into the drain. Finally, the stopper head 40 can be reconnected to the strainer 44 such as by pressing the stopper head 40 into engagement with the upper portion 82 of the strainer 44 until the stopper head engagement feature 84 of the strainer 44 is securely received by the spring-biased latch members 62 of the release mechanism 60. In other instances, the release mechanism 60 may be omitted and the stopper head 40 may be attached to the strainer 44 by other devices, such as, for example, threading the stopper head 40 onto a threaded stem of the strainer 44.

Figure 9:
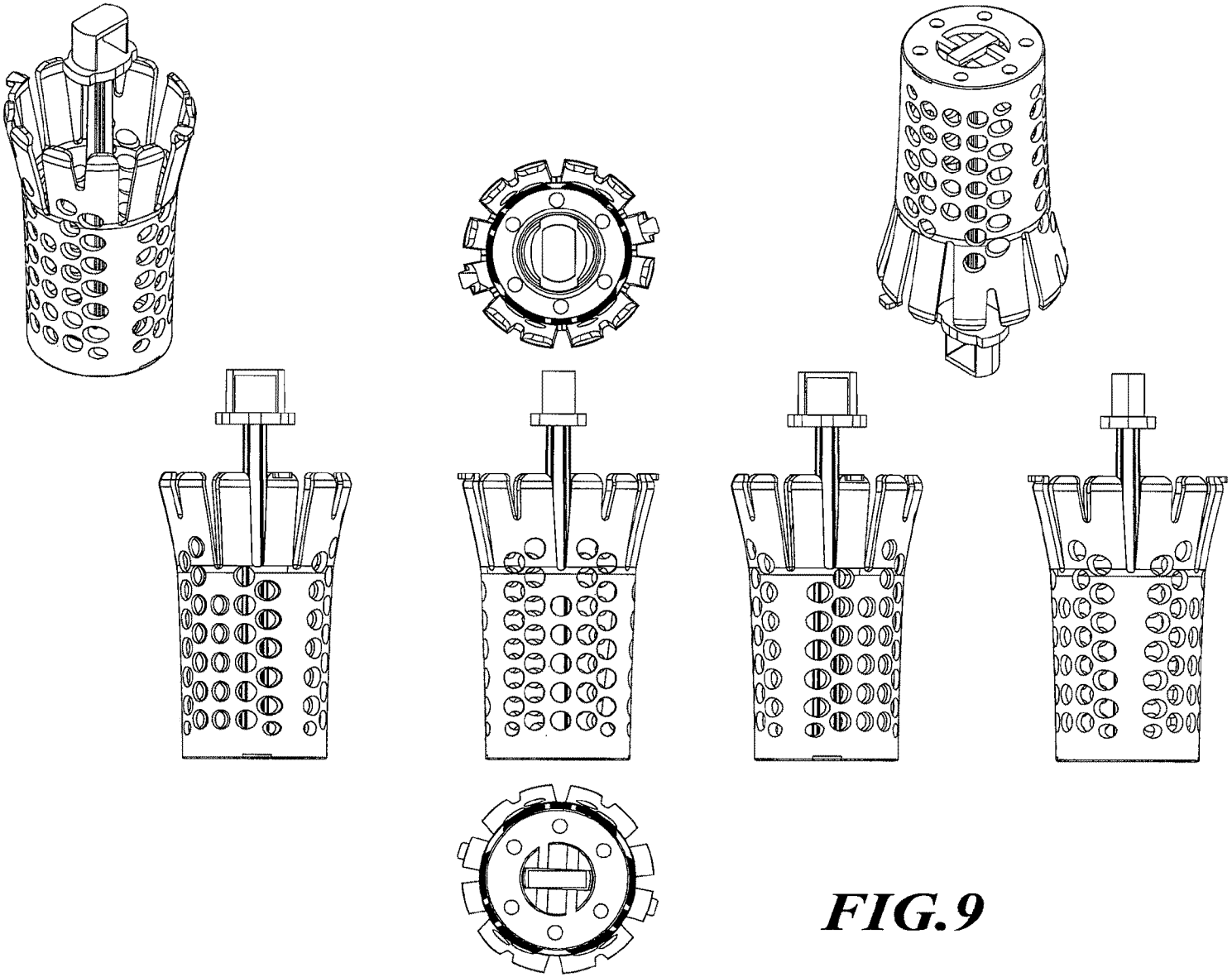
FIG. 9 provides comprehensive views of the strainer of the strainer cartridge of FIG. 1.
Figure 10:
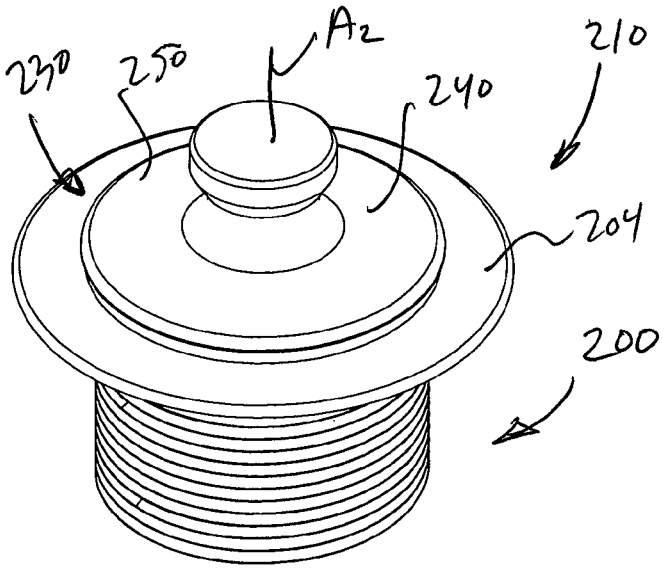
FIG. 10 is an isometric view of a strainer cartridge, according to another example embodiment, shown with the strainer cartridge installed in a drain body and in a plugged configuration.

FIG. 9 provides comprehensive views of the strainer of the stopper cartridge 10 of FIGS. 1-8. Notably, the stem 86 of the strainer 44 includes an upper end that is sized and shaped to be detachably received by the stopper head 40. The receptacle portion of the strainer 44 includes a plurality of elongated relief features in a sidewall thereof to enable the receptacle to flex and conform to the shape of a drain within which the stopper cartridge 10 is installed.

Although the stopper cartridges 10 and components thereof described herein are described as interfacing with a conventional sink arrangement, it is appreciated that the stopper assemblies 10, components thereof and aspects of the same may be used with a variety of different fluid basins to provide the various functionalities described herein. For example, the stopper assemblies 10, components thereof and aspects of the same may be used with a tub or other fluid basin other than a sink.

Figure 11:
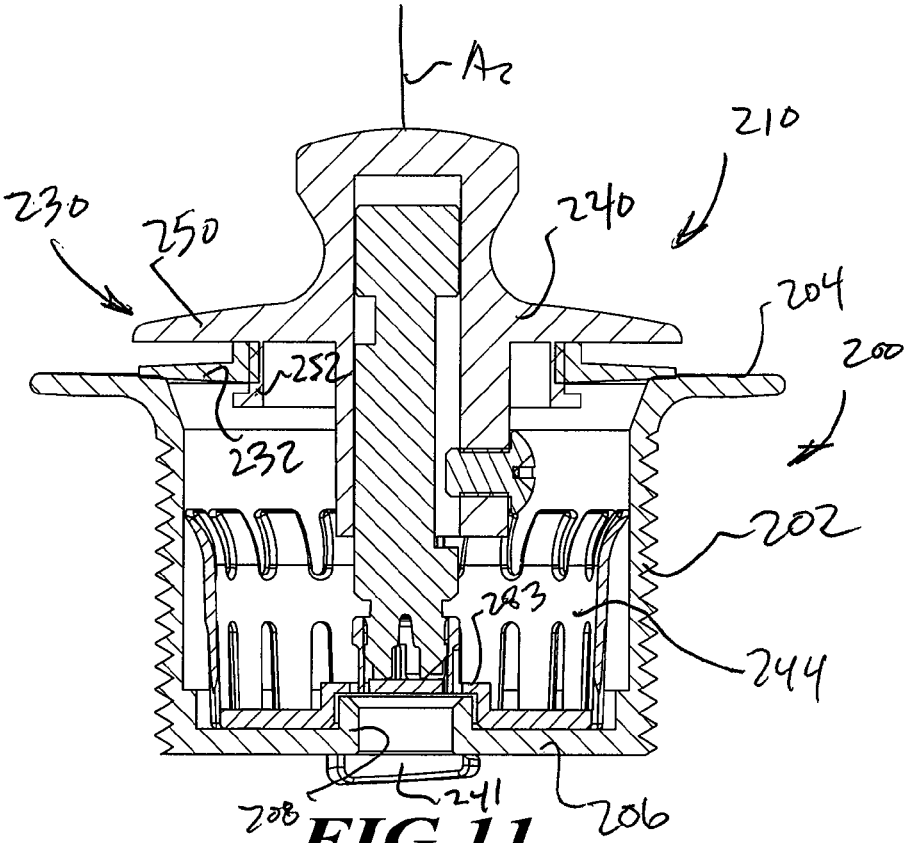
FIG. 11 is a cross-sectional side view of the strainer cartridge of FIG. 10 shown installed in the drain body and in the plugged configuration.
Figure 12:
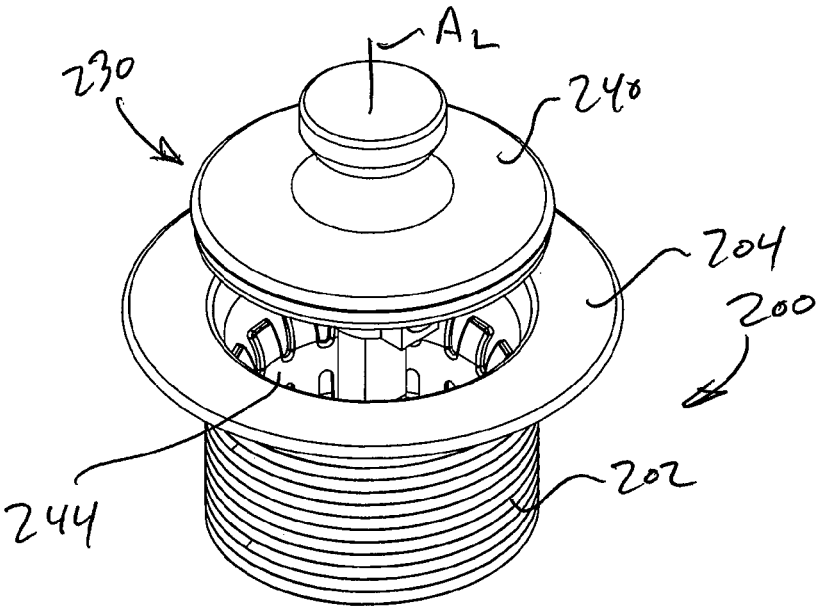
FIG. 12 is an isometric view of the strainer cartridge of FIG. 10 shown with the strainer cartridge installed in the drain body and in an unplugged or drain configuration.
Figure 13:
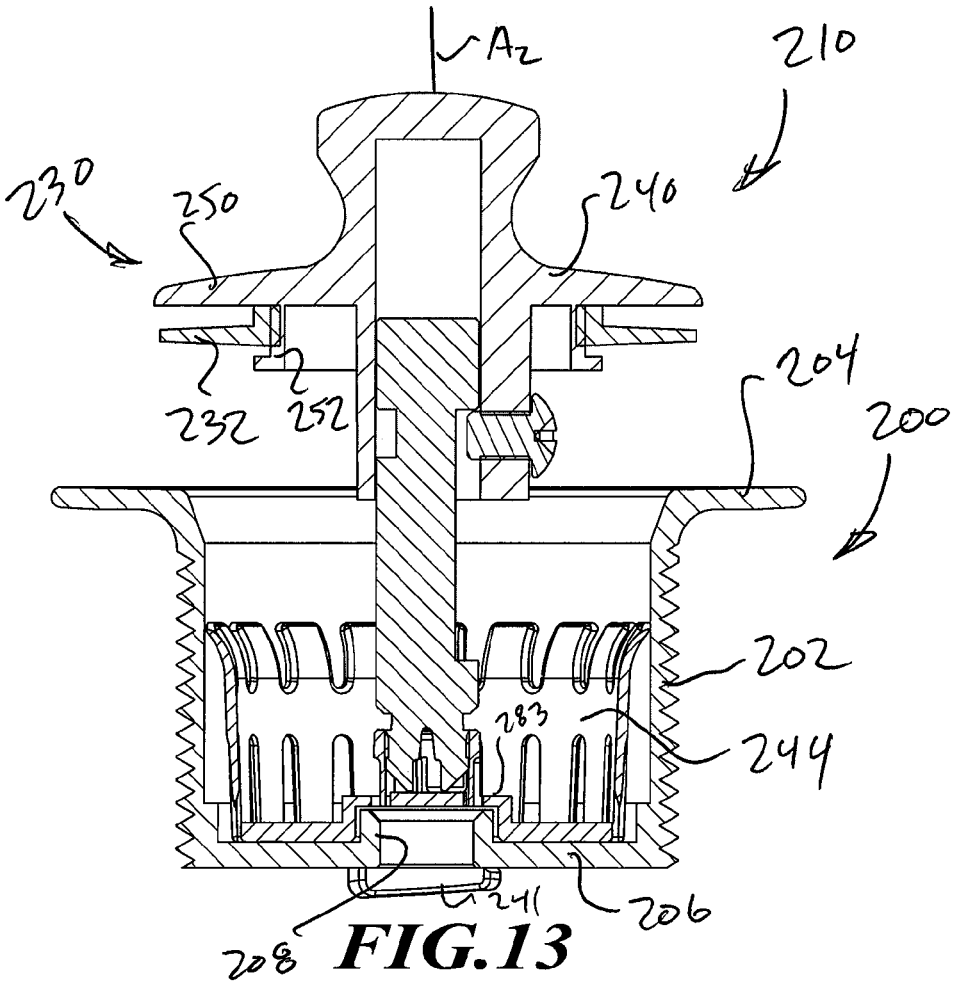
FIG. 13 is a cross-sectional side view of the strainer cartridge of FIG. 10 shown installed in the drain body and in the unplugged or drain configuration.
Figure 14:
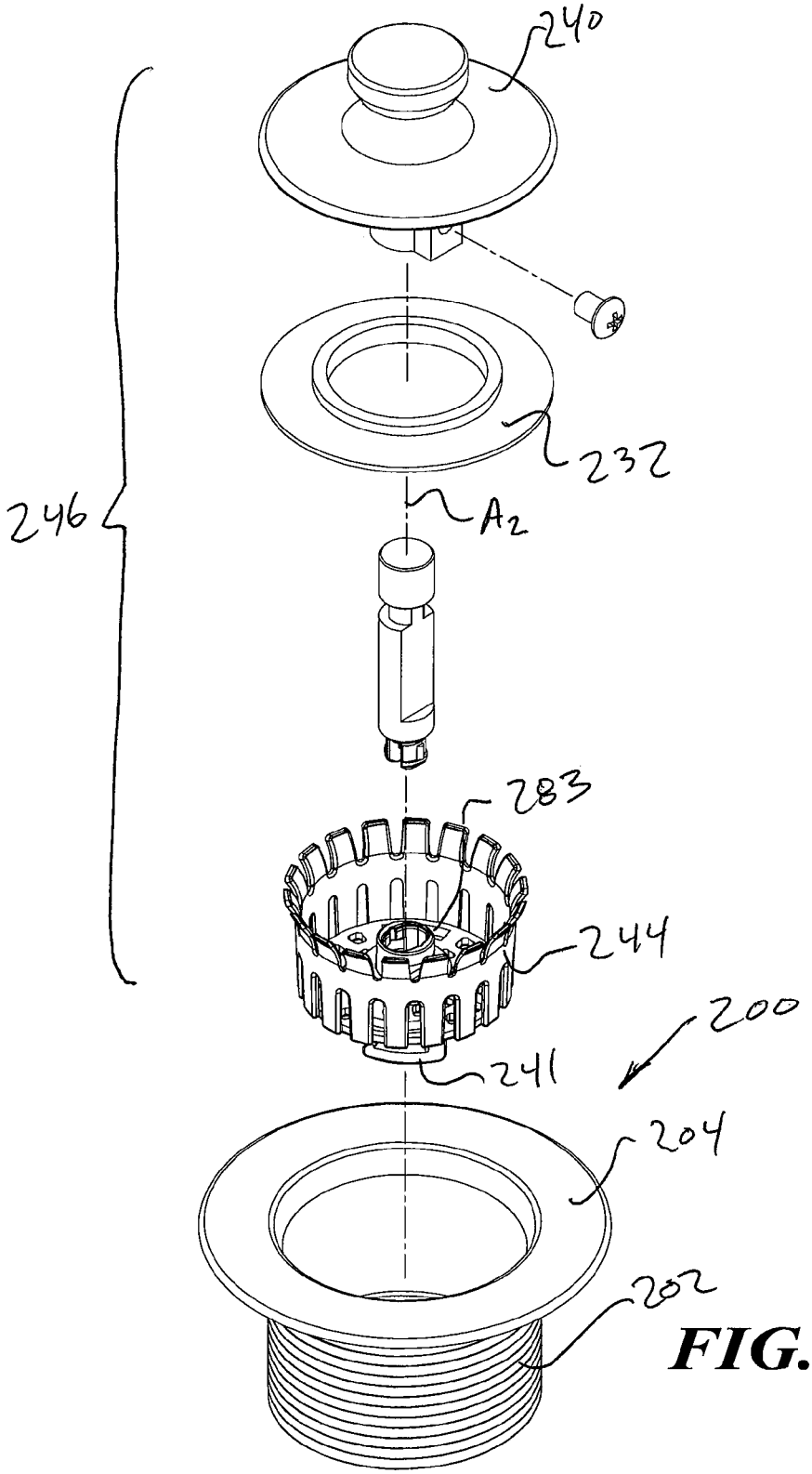
FIG. 14 is an exploded view of the strainer cartridge of FIG. 10 and the drain body.
Figure 15:
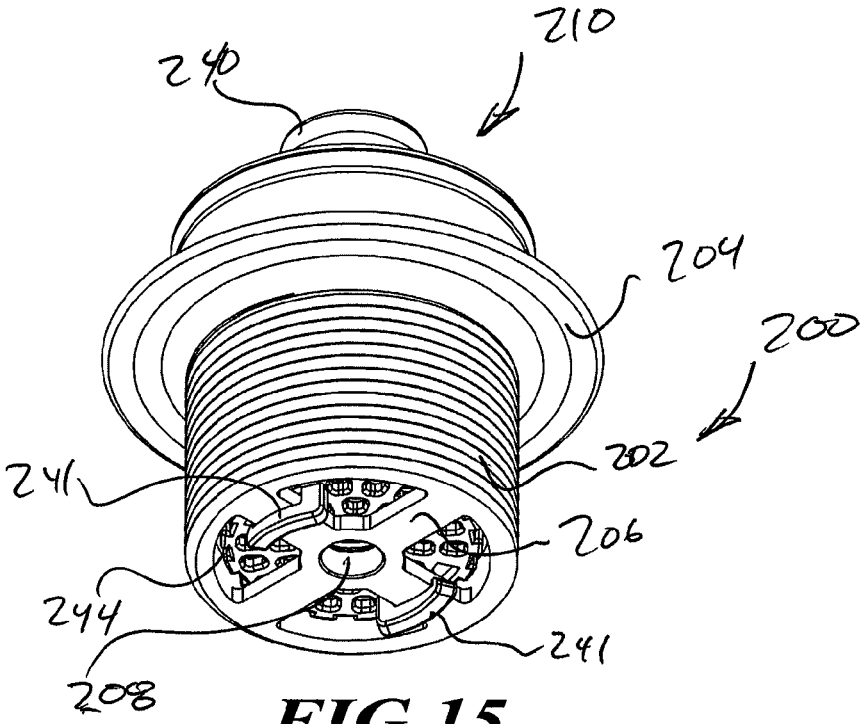
FIG. 15 is an isometric view of the strainer cartridge of FIG. 10 shown with the strainer cartridge attached to the drain body.
Figure 16:
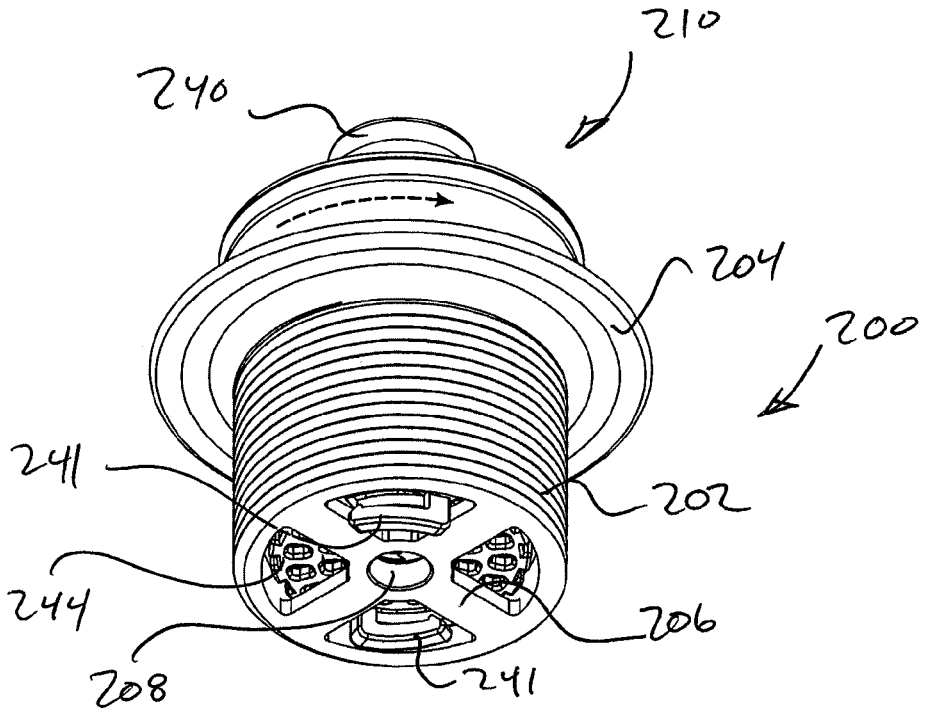
FIG. 16 is an isometric view of the strainer cartridge of FIG. 10 shown with the strainer cartridge detached from the drain body.
Figure 17:
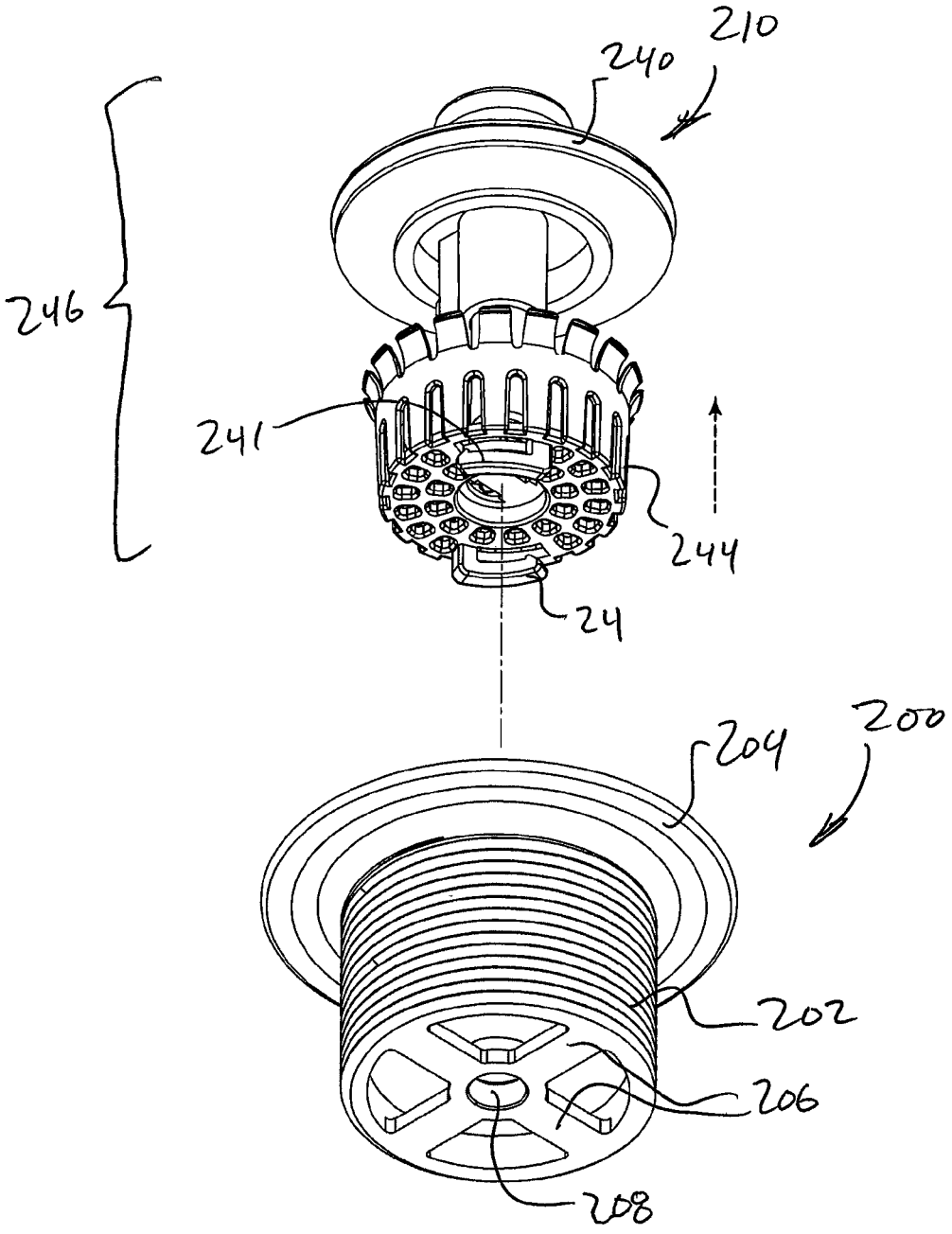
FIG. 17 is an isometric view of the strainer cartridge of FIG. 10 shown with the strainer cartridge removed from the drain body.
Figure 18:
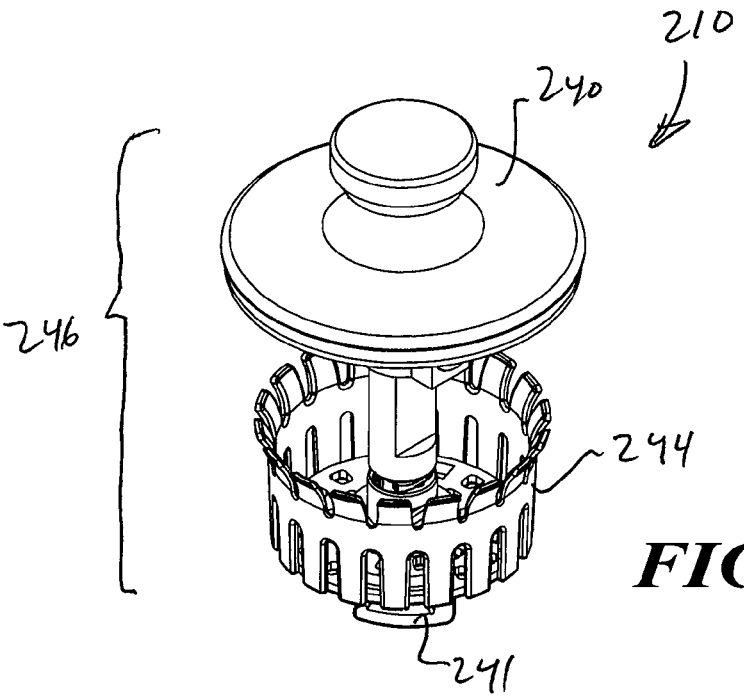
FIG. 18 is an isometric view of the strainer cartridge of FIG. 10.
Figure 19:
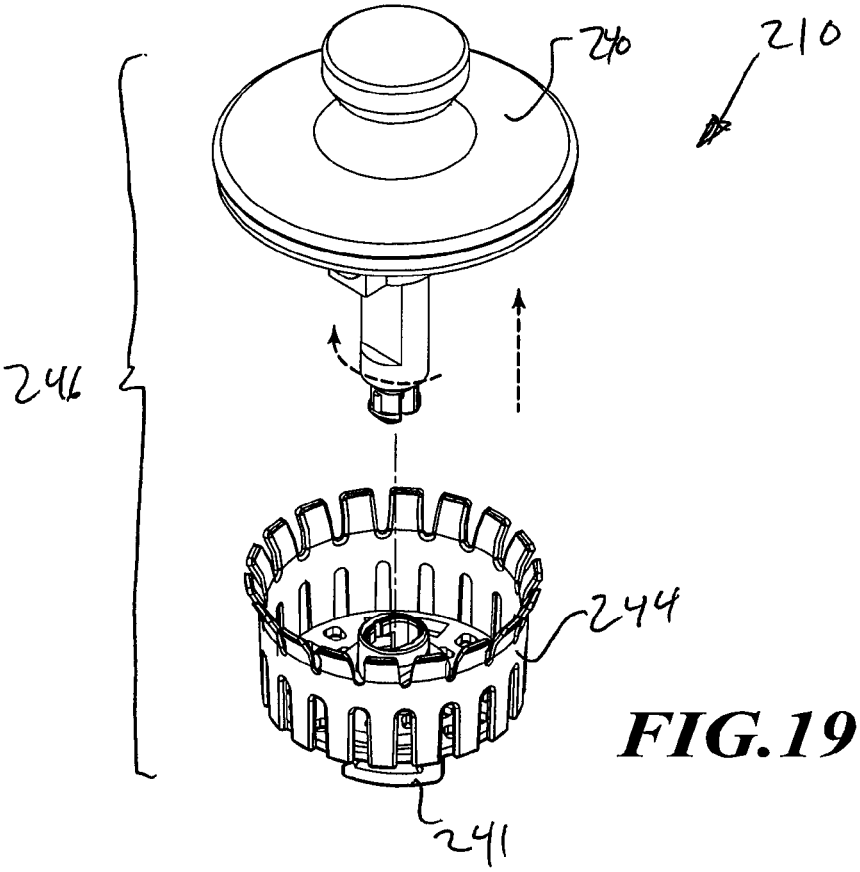
FIG. 19 is an isometric view of the strainer cartridge of FIG. 10 with a strainer thereof detached from a stopper head assembly.
Figure 20:
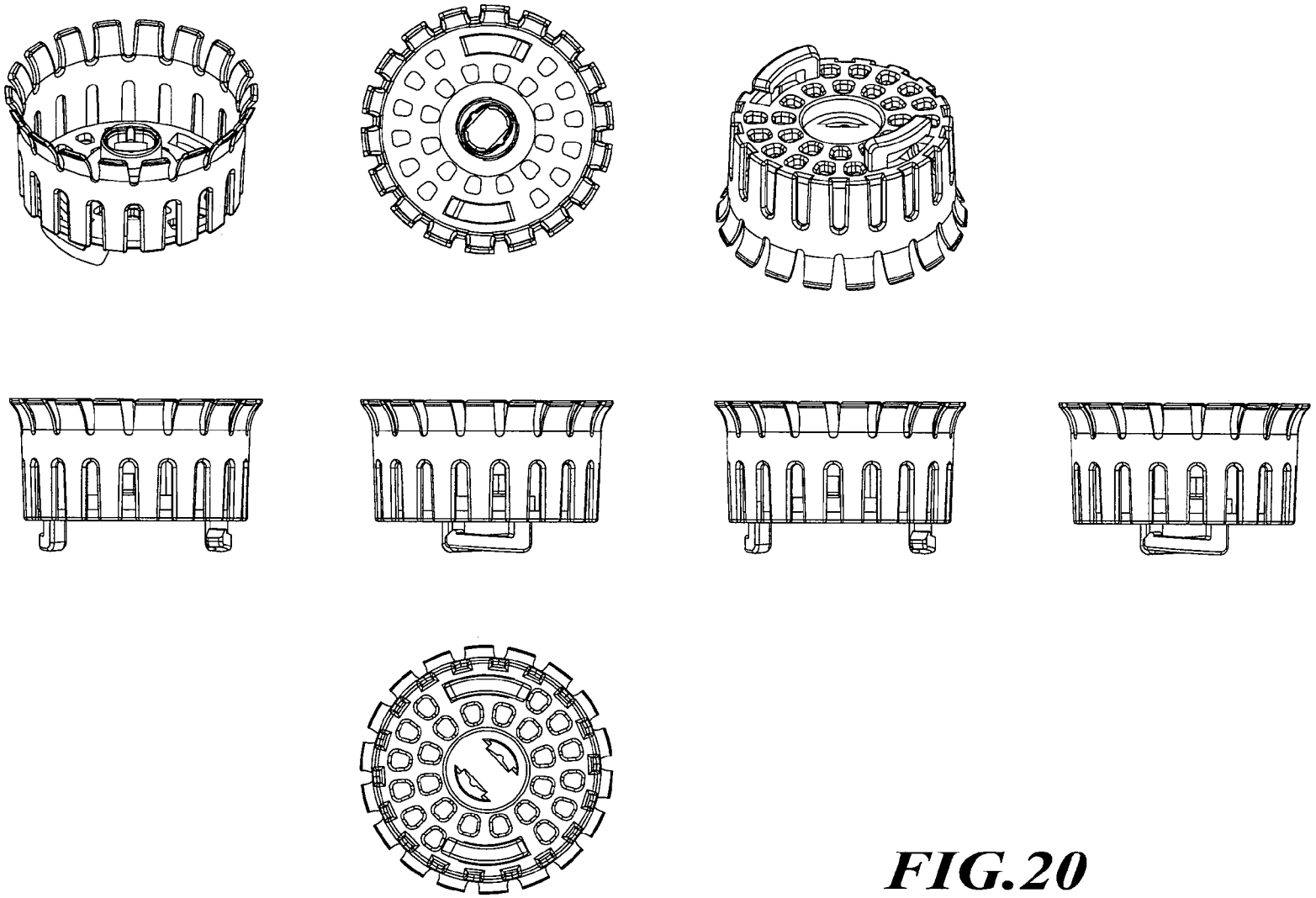
FIG. 20 provides comprehensive views of the strainer of the strainer cartridge of FIG. 10.

FIGS. 10 through 20 show a stopper assembly 210 for a drain system 200 of a fluid basin according to another example embodiment. The stopper assembly 210 is configured to be installed in a fluid basin (e.g., a bathtub) with the stopper assembly 210 movable between an unplugged or drain position, such as shown in FIG. 13, and a plug position, as shown in FIG. 11. In the unplugged or drain position, fluid (e.g., water) may drain out of the fluid basin via the drain system 200. The drain system 200 may include a drain body 202 that extends below the fluid basin and that includes an upper portion having a flange 204 that is received within a drain opening of the basin. The drain body 202 may include a lower grate structure 206 that supports a central hub 208 having internal threads to receive various drain stoppers. The upper end of the drain system 200 may be shaped to closely receive or nest with an upper end 230 of the stopper assembly 210 when the stopper assembly 210 is moved downward from the drain position shown in FIG. 13 to the plug position shown in FIG. 11. The upper end 230 of the stopper assembly 210 may include a seal device 232, such as, for example, a gasket or an o-ring to sealingly engage the drain system 200 when the stopper assembly 210 is moved into the plug position to prevent fluid (e.g., water) from draining out of the basin. In other instances, a seal device 232, such as a bead or lip, may be formed integrally with the upper end 230 of the stopper assembly 210. The stopper assembly 210 may be conveniently moved between the drain position and the plug position by a user, such as by pulling on the upper end 230.

With reference to FIGS. 10 through 20, the stopper assembly 210 comprises a stopper head 240 and a strainer 244. The stopper head 240 is provided at the upper end 230 of the stopper assembly 210 and is selectively attachable to the strainer 244. The strainer 244 is detachably coupled beneath the stopper head 240 to trap debris or other matter as fluid passes through the strainer 244 during use. In other embodiments, the strainer 244 may be fixedly attached or permanently attached to the stopper head 240 or integrally formed therewith. Advantageously, when the strainer 244 is detachably coupled to the stopper head 240, the strainer 244 may be removed with the stopper head 240 and selectively replaced with a replacement strainer 244 in a particularly convenient manner. In other instances, the strainer 244 may be removed with the stopper head 240 and cleaned for reuse in the drain system.

The stopper head 240 may have a generally circular profile similar to conventional stoppers, or may have other shapes. The stopper head 240 may have a general mushroom shape with an enlarged head portion 250 and a reduced neck or stem portion 252. The seal device 232 described above may be positioned around the reduced neck or stem portion 252. The stopper head 240 may further include features for selectively engaging the strainer 244, as discussed in greater detail elsewhere, such that the stopper head 240 and the strainer 244 may be selectively secured as a unit or cartridge 246 into the drain system.

In some instances, the stopper head 240 and/or strainer 244 may include features for selectively engaging the drain body 202 such that the stopper head 240 and the strainer 244 may be selectively secured as a unit or cartridge 246 to the drain body 202. In this manner, the stopper head 240 and/or strainer 244 can be selectively detached and reattached to the drain body 202 as desired.

In other embodiments, the stopper head 240 and/or the strainer 244 may include other features for facilitating selective engagement and disengagement of the stopper head 240 and the strainer 244 as a unit with the drain body 202, such as, for example, a detent mechanism or other fasteners. Irrespective of the particular fastening device, the stopper head 240 and/or the strainer 244 are configured to enable separation of the stopper head 240 and the strainer 244 as a unit from the drain body 202. Advantageously, the stopper head 240 and the strainer 244 attached thereto can therefore be removed as a unit by a user for cleaning or servicing as desired. For example, the strainer 240 may include one or more clip arrangements 241 to lock onto the grate structure of the drain body and secure removably the stopper assembly within the drain body.

As previously indicated, the stopper head 240 may include coupling devices for selectively engaging the strainer 244. For instance, the example embodiment includes a telescoping shaft assembly for coupling the strainer 244 and the stopper head together. The strainer 244 may be released, separated or detached from the stopper head 240.

In other embodiments, the stopper head 240 and the strainer 244 may include other features for facilitating selective engagement and disengagement of the same, such as, for example, a detent mechanism, clips, snaps or other fasteners. Irrespective of the particular coupling mechanism, in some embodiments, the stopper head 240 and the strainer 244 are configured to enable separation of the stopper head 240 from the strainer 244 after the stopper head 240 and strainer 244 are removed as a cartridge 246 from the drain system. For example, in accordance with the example embodiment shown in FIGS. 10 through 20, the strainer 244 is selectively detachable from the stopper head 240 by rotating the strainer 244 relative to the telescoping shaft assembly, or by releasing the shaft assembly from the stopper head 240. In some instances, a release mechanism may be provided on the stopper head 240 to release the strainer 244 without requiring the user to touch the strainer, such as a release mechanism similar to release mechanism 60 shown in the embodiment of FIGS. 1 through 9. This may be particularly advantageous when replacing a strainer 244 that is soiled with debris, such as, for example, hair and other matter that collects in the strainer 244 during use.

In some embodiments, the strainer 244 may include a body portion defining a receptacle 270. The receptacle 270 may include a sidewall 272 extending from a periphery of a base 274. Each of the sidewall 272 and the base 274 may include a plurality of apertures 276 to form a strainer structure to strain fluid passing through the receptacle 270 during operation of the drain system 200. The receptacle 270 may be generally cylindrical and may encircle a portion of the stopper head 240 and/or adapter body 242 when installed for use. In some embodiments, the strainer 244 may taper in a downstream direction such that, when the strainer 244 is in position for use within the drain system 200 and a lower portion of the strainer 244 is blocked with collected debris, fluid can bypass the debris in the strainer 244 via the apertures in the sidewall 272 and a gap between the strainer 244 and the drain body 202 of the drain system 200.

An upstream end of the strainer 244 may include a plurality of flexible fingers 280 that splay outward from the central axis $A_2$ of the strainer 244. The fingers 280 may flex in response to contact with the drain body 202 as the stopper assembly 210 is drawn into the plug position. In the drain position, the fingers 280 may extend near or in close proximity to the drain body 202 or may contact the drain body 202. In this manner, most of the fluid and any matter passing into the drain system 200 inevitably passes through the receptacle 270 of the strainer 244.

The strainer 244 may include a central hub portion 283 having engagement feature(s) to detachably couple the strainer 244 directly or indirectly to the stopper head 240 to form the strainer cartridge 246.

With reference to FIGS. 11 and 13, the telescoping shaft and stopper head 240 may be configured to telescope between the plug position shown in FIG. 11 and the unplugged or drain position shown in FIG. 13. For example, the shaft assembly 253, 254 may include an inner shaft 253 and an outer shaft 254 wherein the inner shaft 253 is extendable from the outer shaft 254 to facilitate movement between the plug position shown in FIG. 11 and the unplugged or drain position shown in FIG. 13.

A method of using the stopper assembly 210 to remove debris from a drain system of a fluid basin will now be described. The method may begin with installing the stopper assembly 210 in the drain system 200. Fluid and debris may then be intermittently passed through the drain system 200 as the fluid basin is used on a daily or periodic basis. As the fluid and debris flows through the drain system 200, a substantial portion passes through the strainer 244 of the stopper assembly 210 and at least some or a significant portion of the debris will become trapped in the strainer 244. Debris may therefore accumulate in the strainer 244 over time. The strainer 244 may then be removed and cleaned or replaced as desired to clear the drain system 200 of the collected debris.

In particular, the strainer cartridge 246, which comprises the stopper head 240 and the strainer 244 holding the debris, may be detached from the drain body 202. Detaching the strainer cartridge 246 may include, for example, rotating the strainer cartridge 246 about the central axis $A_2$, such that corresponding engagement features provided between the strainer cartridge 246 and the drain body 202 disengage.

After detaching the strainer cartridge 246, the strainer cartridge 246 may be removed from the drain system 200 by simply pulling it out. In this manner, the strainer cartridge 246 can be quickly removed from the drain system 200 with minimal effort and without disassembling the drain system 200.

After removing the strainer cartridge 246 from the drain system 200, the strainer 244 and the debris collected therein can be removed from the stopper head 240 if desired. Once removed, the strainer 244 may be deposited into a waste or compost receptacle. Next, a replacement strainer 244 may be attached to the stopper head 240 to form a replacement strainer cartridge 246, and the replacement strainer cartridge 246 may be attached to the drain body 242 in the drain system 200. Alternatively, the debris collected in the strainer 244 may be emptied into a waste or compost receptacle and the strainer 244 reattached to the stopper head 240 for reuse.

Other methods of removing debris or otherwise reducing clogging of a drain system of a fluid basin may be provided in view of the stopper assemblies, components and systems described herein. For example, a method of reducing clogging may include installing a strainer cartridge 246, comprising a stopper head 240 and a strainer 244 coupled to the stopper head 240, into the drain system 200 of the fluid basin; operating the drain system with the strainer cartridge 246 in position; removing the strainer cartridge 246 from the drain system after the strainer 244 has captured debris; detaching the strainer 244 and debris therein from the stopper head 240; attaching a replacement strainer 244 to the stopper head 240 to form a replacement strainer cartridge 246; and installing the replacement strainer cartridge 246 into the drain system 200 of the fluid basin.

U.S. Provisional Patent Application No. 62/757,624, filed Nov. 8, 2018, is incorporated herein by reference, in its entirety.

Moreover, aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A stopper assembly for a drain system of a fluid basin, the stopper assembly comprising:

a stopper head having a seal to sealingly engage the drain system of the fluid basin when the stopper assembly is moved from a drain position to a plug position; and a strainer detachably coupled to the stopper head to strain at least a portion of a flow of fluid passing through the drain system of the fluid basin when the stopper assembly is installed and the stopper head is in the drain position, and wherein the strainer includes a cylindrical body having an open upper end and a plurality of apertures to form a strainer structure to strain a flow of fluid passing through the strainer during operation of the drain system, and wherein the open upper end of the cylindrical body of the strainer includes a plurality of flexible fingers that splay outward from a central axis of the strainer, at least one of the flexible fingers including a laterally extending projection that extends from the flexible finger to collectively form an upside down L-shaped structure when viewing the stopper assembly in an upright orientation with the stopper head above the strainer, which upside down L-shaped structure is configured to support the stopper assembly in the drain position within the drain system and configured to flex inwardly when a user moves the stopper assembly from the drain position to the plug position.

2. The stopper assembly of claim 1 wherein the strainer is detachably coupled to the stopper head via a user actuatable release mechanism to facilitate replacement of the strainer with a replacement strainer.

3. The stopper assembly of claim 1 wherein the cylindrical body of the strainer defines a receptacle, the receptacle including a base and a sidewall extending from a periphery of the base, each of the base and the sidewall including the plurality of apertures that form the strainer structure.

4. The stopper assembly of claim 3 wherein the plurality of flexible fingers are provided at an upper end of the sidewall, and wherein at least two of the flexible fingers include a respective laterally extending projection configured to support the stopper assembly in the drain position within the drain system and configured to flex inwardly when the user moves the stopper assembly from the drain position to the plug position.

5. The stopper assembly of claim 4 wherein the laterally extending projections of the flexible fingers are configured to collectively support the stopper assembly in the drain position within the drain system and are configured to flex inwardly when the user moves the stopper assembly from the drain position to the plug position.

6. The stopper assembly of claim 5 wherein the laterally extending projections of the flexible fingers extend horizontally away from the central axis.

7. The stopper assembly of claim 1 wherein the stopper head and the strainer form a strainer cartridge that is removably insertable in the drain system, and configured to be moved between the drain positions and the plug position.

8. The stopper assembly of claim 1 wherein the stopper head includes a pair of actuatable elements to selectively release the strainer from the stopper head, the actuatable elements including strainer engagement portions biased inwardly toward each other.

9. The stopper assembly of claim 1 wherein the strainer includes an elongate stem portion that is detachable from the cylindrical body.

10. The stopper assembly of claim 9 wherein an upper end of the elongate stem portion includes a stopper head engagement feature to detachably couple the strainer to the stopper head.

11. A stopper assembly for a drain system of a fluid basin having a drain body with a grate structure, the stopper assembly comprising:

a stopper head to sealingly engage the drain system of the fluid basin when the stopper assembly is moved from a drain position to a plug position; and a strainer detachably coupled to the stopper head to strain at least a portion of a flow of fluid passing through the drain system of the fluid basin when the stopper assembly is installed and the stopper head is in the drain position, wherein the strainer includes a strainer floor having a plurality of apertures formed therein to assist in straining the flow of fluid, and wherein the strainer includes one or more clip arrangements extending from the strainer floor being configured to lock onto the grate structure of the drain body and removably secure the stopper assembly within the drain body and maintain the strainer in a fixed vertical position within the drain body while the stopper head is moved between the drain position and the plug position during use.

12. The stopper assembly of claim 11 wherein the strainer is detachably coupled to the stopper head via a user actuatable release mechanism to facilitate replacement of the strainer with a replacement strainer.

13. The stopper assembly of claim 11 wherein the stopper head and the strainer form a strainer cartridge that is selectively detachable from grate structure of the drain body.

14. The stopper assembly of claim 13 wherein the strainer cartridge is detachable from the grate structure by rotating the strainer cartridge about a central axis such that the one or more clip arrangements of the strainer is/are released from the grate structure.

15. The stopper assembly of claim 11 wherein the strainer includes a body having a plurality of apertures to form a strainer structure to strain a flow of fluid passing through the strainer during operation of the drain system.

16. The stopper assembly of claim 11 wherein the body of the strainer defines a receptacle, the receptacle including a base and a sidewall extending from a periphery of the base, each of the base and the sidewall including the plurality of apertures that form the strainer structure.

17. The stopper assembly of claim 16 wherein the one or more clip arrangements extend from the base of the receptacle.

18. The stopper assembly of claim 11 wherein the one or more clip arrangements are integrally formed in the strainer.

19. The stopper assembly of claim 18 wherein the one or more clip arrangements are L-shaped and project from a lower end of the strainer.

20. A strainer of a strainer cartridge for a drain system, the strainer comprising:

a body defining a receptacle, the receptacle including a base floor and a sidewall extending from a periphery of the base, each of the base and the sidewall including a plurality of apertures to form a strainer structure to strain a flow of fluid passing through the receptacle during operation of the drain system; and one or more clip arrangements projecting from a lower end of the base floor of the body, the one or more clips configured to removably secure the strainer cartridge within the drain system and maintain the strainer in a fixed vertical position within the drain body while the stopper head is moved between the drain position and the plug position during use.

* * * * *